US012551076B2

(12) United States Patent
Stuive et al.

(10) Patent No.: US 12,551,076 B2
(45) Date of Patent: Feb. 17, 2026

(54) CLEANING APPARATUS ROTARY SCRUBBING TOOL

(71) Applicant: BISSELL Inc., Grand Rapids, MI (US)

(72) Inventors: Eric J. Stuive, Zeeland, MI (US); Jecori Owens-Shuler, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 0 days.

(21) Appl. No.: 18/736,880

(22) Filed: Jun. 7, 2024

(65) Prior Publication Data

US 2024/0407619 A1 Dec. 12, 2024

Related U.S. Application Data

(60) Provisional application No. 63/472,411, filed on Jun. 12, 2023.

(51) Int. Cl.

| | |
|---|---|
| ***A47L 11/40*** | (2006.01) |
| ***A47L 11/30*** | (2006.01) |
| ***A47L 11/34*** | (2006.01) |

(52) U.S. Cl.

CPC ..... *A47L 11/4038* (2013.01); *A47L 11/305* (2013.01); *A47L 11/34* (2013.01);

(Continued)

(58) Field of Classification Search

CPC .. A47L 11/40; A47L 11/4036; A47L 11/4038; A47L 11/4044; A47L 11/408;

(Continued)

(56) References Cited

U.S. PATENT DOCUMENTS 1,821,715 A * 9/1931 Kuchinsky ..... A47L 11/4069 15/322
3,686,707 A * 8/1972 Hughes ..... A47L 11/30 15/385

(Continued)

FOREIGN PATENT DOCUMENTS

CN 217310127 U 8/2022
CN 218650761 U 3/2023

(Continued)

OTHER PUBLICATIONS

Hoover SpinScrub Stain Remover Hand Tool, Vacuum Powered Brush Attachment, Upholstery and Stair Cleaner, FH01000, Green/Back, https://www.amazon.com/Hoover-SpinScrub-Powered-Hand-FH01000/dp/B005XNBYWC; accessible as early as Jul. 1, 2014.

(Continued)

*Primary Examiner* — Carlos A. Rivera
(74) *Attorney, Agent, or Firm* — Price Heneveld LLP

(57) ABSTRACT

A cleaning apparatus includes a housing, a suction assembly, and a liquid delivery system. A wand is in fluid communication with the suction assembly and the liquid delivery system via an accessory hose. A rotary scrubbing tool is selectively coupled to the wand. The rotary scrubbing tool includes a motor assembly and a support member. A pad base is operably coupled to the motor assembly for driving rotation of the pad base. The pad base defines an air outlet and a liquid outlet proximate to a central rotational axis and a fluid inlet proximate to a peripheral edge. The suction assembly directs air through the air outlet, across the pad base, and through the fluid inlet. Liquid dispensed from the liquid delivery system via the liquid outlet is directed across the pad base and through the fluid inlet by the suction assembly.

16 Claims, 12 Drawing Sheets

(52) U.S. Cl.
CPC ..... *A47L 11/4069* (2013.01); *A47L 11/4083* (2013.01); *A47L 11/4088* (2013.01)

(58) Field of Classification Search
CPC .. A47L 11/4083; A47L 11/4088; A47L 11/00; A47L 11/02; A47L 11/20; A47L 11/204; A47L 11/22; A47L 11/29; A47L 11/302; A47L 11/305; A47L 11/34; A47L 7/02
See application file for complete search history.

(56) References Cited

U.S. PATENT DOCUMENTS

| | | | | | |
|---|---|---|---|---|---|
| 3,919,729 | A | * | 11/1975 | Cannan | A47L 11/4083 134/21 |
| 4,182,001 | A | * | 1/1980 | Krause | A47L 11/4088 15/385 |
| 5,163,203 | A | | 11/1992 | Tanasescu et al. | |
| 5,428,863 | A | * | 7/1995 | Tanasescu | A47L 11/4044 15/384 |
| 5,970,574 | A | | 10/1999 | Thrash, Jr. | |
| 6,185,781 | B1 | | 2/2001 | Miller et al. | |
| 9,038,234 | B2 | | 5/2015 | Monson | |
| 9,119,518 | B2 | | 9/2015 | Hruby | |
| 9,295,366 | B2 | | 3/2016 | Pearlstein | |
| 10,022,031 | B2 | | 7/2018 | Bruders et al. | |
| 10,264,939 | B2 | | 4/2019 | Studebaker et al. | |
| 2014/0115816 | A1 | | 5/2014 | Bruders et al. | |
| 2021/0153709 | A1 | | 5/2021 | Luyckx | |

FOREIGN PATENT DOCUMENTS

| | | | |
|---|---|---|---|
| DE | 3515711 | A1 | 11/1986 |
| DE | 4225237 | A1 | 2/1994 |
| DE | 102023114140 | A1 | 12/2024 |
| EP | 0268284 | A2 | 5/1988 |
| EP | 0626817 | B1 | 9/1996 |
| EP | 2656765 | A2 | 10/2013 |
| FR | 2530135 | A1 | 1/1984 |
| GB | 2499148 | B | 4/2014 |
| WO | 9315646 | A1 | 8/1993 |

OTHER PUBLICATIONS

VAX SpotWash Home Pet-Design Carpet Cleaner—Teal and Grey, https://www.amazon.com/Hoover-SpinScrub-Powered-Hand-FH01000/dp/B005XNBYWC; accessible as early as Nov. 21, 2022.

* cited by examiner

CLEANING APPARATUS ROTARY SCRUBBING TOOL

CROSS-REFERENCE TO RELATED APPLICATION

This application claims priority to and the benefit under 35 U.S.C. § 119 (e) of U.S. Provisional Application No. 63/472,411, filed on Jun. 12, 2023, entitled, "CLEANING APPARATUS ROTARY SCRUBBING TOOL," the disclosure to which is hereby incorporated herein by reference in its entirety.

FIELD OF THE DISCLOSURE

The present disclosure generally relates to a rotary scrubbing tool, and more particularly to a rotary scrubbing tool that can be selectively used with an extraction cleaning apparatus.

BACKGROUND OF THE DISCLOSURE

Cleaning products can have wands attached thereto to selectively couple with accessory tools to provide cleaning functions. Additionally, cleaning products can use multiple systems and assemblies, with or without an accessory, to provide cleaning functions to surfaces.

SUMMARY OF THE DISCLOSURE

According to one aspect of the present disclosure, a cleaning apparatus includes a housing, a suction assembly, and a liquid delivery system. A wand is in fluid communication with the suction assembly and the liquid delivery system via an accessory hose. A rotary scrubbing tool is selectively coupled to the wand. The rotary scrubbing tool includes a motor assembly. A support member includes a connector and a guide. The connector is configured to couple to the wand. A pad base is operably coupled to the motor assembly within an interior of the guide for driving rotation of the pad base. The pad base defines an air outlet and a liquid outlet proximate to a central rotational axis and a fluid inlet proximate to a peripheral edge of the pad base. The suction assembly directs air through the air outlet, across the pad base, and through the fluid inlet. Liquid dispensed from the liquid delivery system via the liquid outlet is directed across the pad base and through the fluid inlet by the suction assembly.

According to another aspect of the present disclosure, a rotary scrubbing tool for a cleaning apparatus where the cleaning apparatus has a liquid delivery system and a suction assembly, and the rotary scrubbing tool includes a motor housing. A motor assembly is operably coupled with the motor housing. A support member includes a connector for engaging a wand of said cleaning apparatus and a guide coupled to the motor housing. A pad base is operably coupled to the motor assembly within an interior of the guide to drive rotation of the pad base. The pad base defines an air outlet proximate to a central rotational axis, a plurality of liquid outlets adjacent to the air outlet, and a plurality of fluid flow channels extending from the air outlet to proximate to a peripheral edge of the pad base. The plurality of liquid outlets is defined in the plurality of fluid flow channels. The pad base also defines at least one fluid inlet in each of the plurality of fluid flow channels and adjacent to the peripheral edge. Liquid from said liquid delivery system is configured to be dispensed through the plurality of liquid outlets. An airflow generated by said suction assembly is configured to be directed through the air outlet, along the plurality of fluid flow channels, and through the plurality of fluid inlets, where the airflow configured to distribute the liquid in the plurality of fluid flow channels and across the pad base.

According to one aspect of the present disclosure, a rotary scrubbing tool for a cleaning apparatus where the cleaning apparatus has a liquid delivery system and a suction assembly, and the rotary scrubbing tool includes a motor housing defining air vents. A motor assembly is operably coupled with the motor housing. A support member includes a connector for engaging a wand of said cleaning apparatus and a guide coupled to the motor housing. A pad base is operably coupled to the motor assembly within an interior of the guide to drive rotation of the pad base. The pad base defines an air outlet proximate to a central rotational axis, at least one fluid flow channel extends from the air outlet to a peripheral edge of the pad base, at least one liquid outlet proximate to the air outlet is in the at least one fluid flow channel and at least one fluid inlet is proximate to the peripheral edge in the at least one fluid flow channel. A fluid flow path is defined across the pad base from the air outlet, through the at least one fluid flow channel, and to the at least one fluid inlet. Liquid is dispensed from the at least one liquid outlet and distributed across the pad base by air flowing along the fluid flow path.

These and other features, advantages, and objects of the present disclosure will be further understood and appreciated by those skilled in the art by reference to the following specification, claims, and appended drawings.

DETAILED DESCRIPTION

Figure 1:
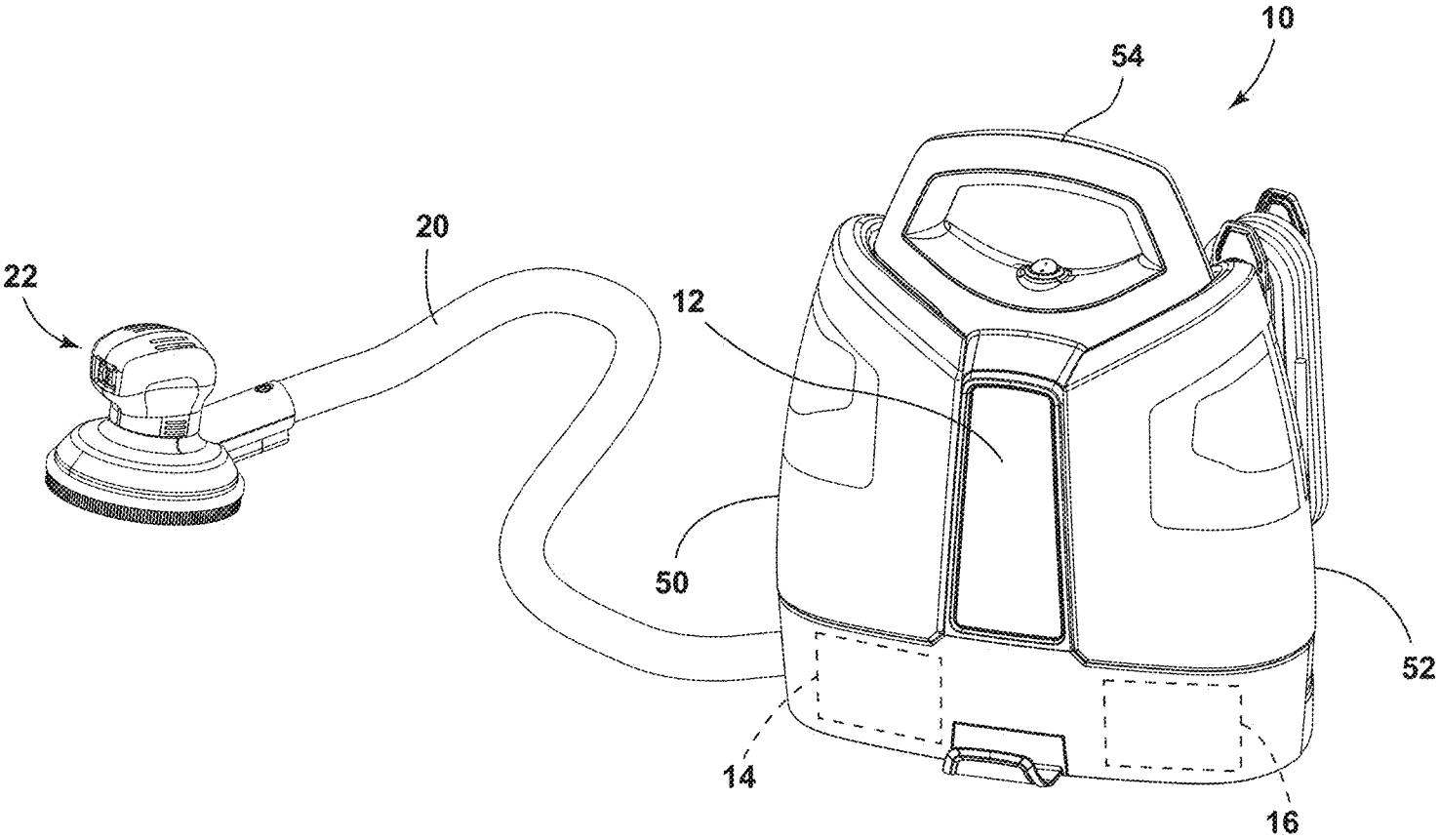
FIG. 1 is a side perspective view of a portable cleaning apparatus with a rotary scrubbing tool, according to the present disclosure.

The present illustrated embodiments reside primarily in combinations of method steps and apparatus components related to a cleaning apparatus rotary scrubbing tool. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof, shall relate to the disclosure as oriented in FIG. 1. Unless stated otherwise, the term "front" shall refer to a surface closest to an intended viewer, and the term "rear" shall refer to a surface furthest from the intended viewer. However, it is to be understood that the disclosure may assume various alternative orientations, except where expressly specified to the contrary. It is also to be understood that the specific structures and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

With reference to FIGS. 1-12, reference numeral 10 generally designates a cleaning apparatus that includes a support or base housing 12, a suction assembly 14 operably coupled with the base housing 12, and a liquid delivery system 16 operably coupled to the base housing 12. A wand 18 is coupled to the base housing 12 and in fluid communication with the suction assembly 14 and the liquid delivery system 16 via an accessory hose 20. A rotary scrubbing tool 22 is selectively coupled to the wand 18. The rotary scrubbing tool 22 includes a motor assembly 24, a support member 26, and a pad base 28. The support member 26 includes a connector 30 configured to couple to the wand 18 and a guide 32. The pad base 28 is operably coupled to the motor assembly 24 within an interior 100 of the guide 32 for driving rotation of the pad base 28. The pad base 28 defines an air outlet 34 and one or more liquid outlets 36 proximate to a central rotational axis 38, as well as one or more fluid inlets 40 proximate to an outer peripheral edge 42 of the pad base 28. The suction assembly 14 is configured to direct air through the air outlet 34, across the pad base 28, and through the fluid inlets 40. Liquid dispensed from the liquid delivery system 16 via the liquid outlets 36 is directed with the air across the pad base 28 and through the fluid inlets 40 by the suction assembly 14.

Figure 2:
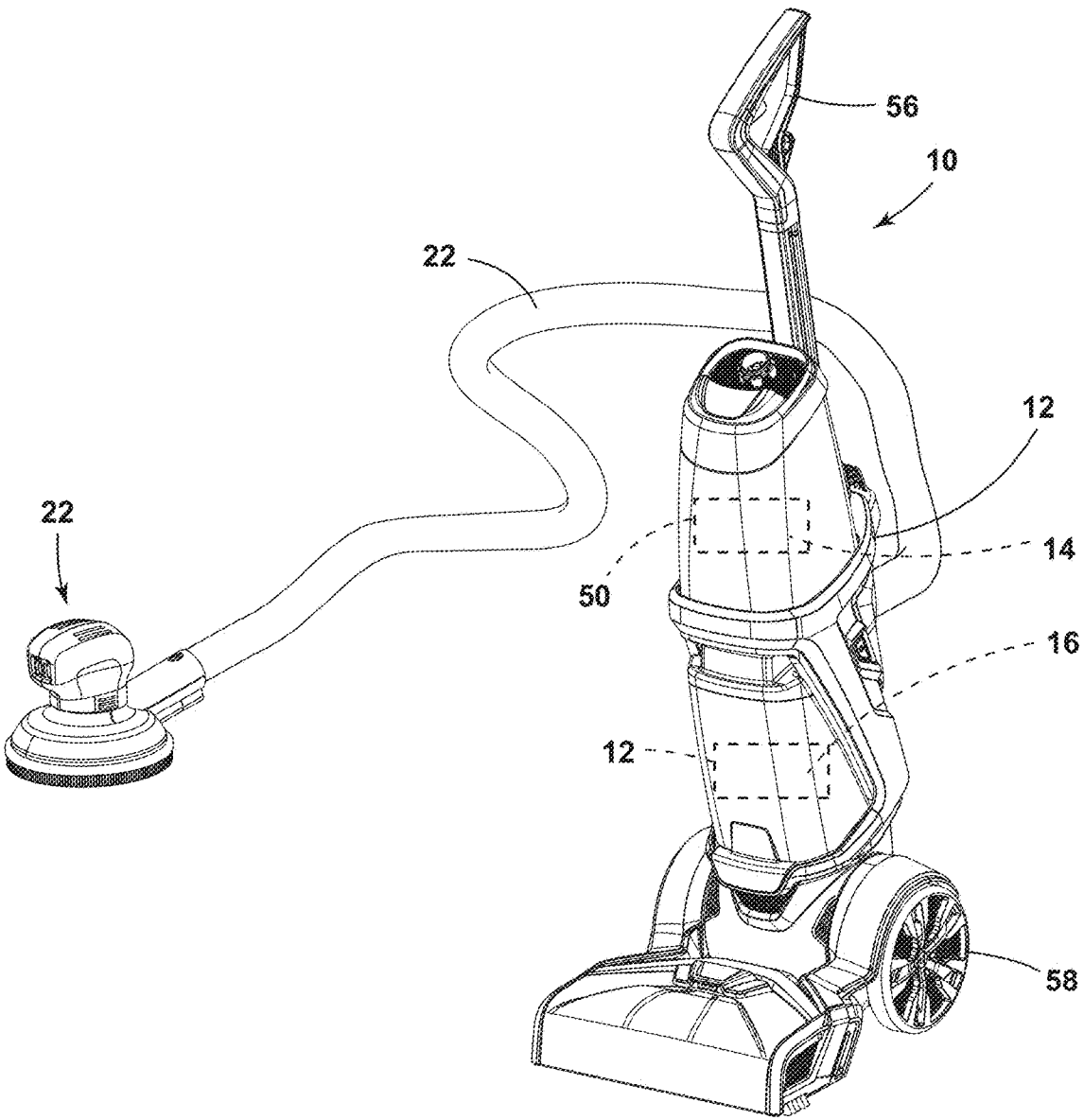
FIG. 2 is a side perspective view of an upright cleaning apparatus with a rotary scrubbing tool, according to the present disclosure.

Referring to FIGS. 1 and 2, the rotary scrubbing tool 22 may be selectively coupled to a variety of cleaning apparatuses 10. Each configuration of the cleaning apparatus 10 generally includes the base housing 12 operably coupled with the suction assembly 14 and the liquid delivery system 16. The suction assembly 14 and the liquid delivery system 16 may collectively be referred to as a fluid directing system or a fluid delivery and recovery system. The fluid directing system is configured to direct fluid in multiple directions and is also configured to direct both liquids and air. The suction assembly 14 is configured to draw fluid into the base housing 12, while the liquid delivery system 16 is configured to direct liquids out of the base housing 12.

The suction assembly 14 generally includes a suction source, such as a motorized fan assembly, configured to draw fluid, such as air and liquids, into a recovery tank or container 50 operably coupled with the base housing 12. The suction assembly 14 typically operates to produce a suction or vacuum effect to draw fluid and/or debris materials from a surface to be cleaned into the recovery container 50. The recovery container 50 may be selectively removed from the base housing 12 to dispose of the liquids and debris materials captured by the suction assembly 14 in the recovery container 50. The cleaning apparatus 10 may include a separator to separate the liquids and debris materials from the airflow for collection.

The liquid delivery system 16 is configured to direct liquids from a supply tank 52 and out of the base housing 12 for use in a cleaning process. The cleaning apparatus 10 includes the supply tank 52 operably coupled to the base housing 12, which is configured to hold and store the liquid. The liquid may be water, a cleaning solution, or combinations thereof. For example, many household extraction cleaning tasks can be performed using water along with or in combination with a liquid cleaning solution that contains surfactants, stabilizers, fragrances, and/or other active and inactive ingredients. The liquid delivery system 16 includes a pump, valves, or other similar features to direct the liquid out of the supply tank 52 and, consequently, out of the cleaning apparatus 10. The cleaning apparatus 10 may optionally include a heater to heat or warm the liquid that is dispensed.

Referring still to FIGS. 1 and 2, the cleaning apparatus 10 may be an extraction cleaner, which is often used to clean rugs, carpeting, drapes, and upholstered surfaces. The cleaning apparatus 10 may be used with a tool or accessory, which may clean similar surfaces and/or hard surfaces. The cleaning apparatus 10 may be configured as a portable cleaning apparatus 10, such as the example illustrated in FIG. 1. Portable cleaning apparatuses 10 are generally smaller and lighter and often include a handle 54 by which the user may pick up and carry the portable cleaning apparatus 10.

As illustrated in FIG. 2, the cleaning apparatus 10 may additionally or alternatively be configured as an upright cleaning apparatus 10. The upright cleaning apparatus 10 includes an elongated handle 56, which the user may use to move and maneuver the upright cleaning apparatus 10 along an underlying surface. Generally, the user maneuvers the upright cleaning apparatus 10 via wheels 58 operably coupled to the base housing 12 to roll the upright cleaning apparatus 10 on the underlying surface. Often, the upright cleaning apparatus 10 has a drive assembly to assist the user in maneuvering the upright cleaning apparatus 10. The upright cleaning apparatus 10 is generally larger and heavier compared to the portable cleaning apparatuses 10, having a lower surface proximate to the wheels 58 to engage an underlying floor surface.

The portable cleaning apparatuses 10 and the upright cleaning apparatuses 10 may perform the same functions, perform different functions, perform overlapping functions, etc. The functions of the cleaning apparatus 10 may be performed separately from the tool or accessory or may be utilized by the tool or accessory. For example, the cleaning apparatus 10 may be operable to deliver room temperature water, heated water, a chemical cleaning solution, or combinations thereof to the tool and/or a surface to be cleaned with the cleaning apparatus 10. Similarly, the cleaning apparatus 10 may be configured to generate a vacuum effect to capture fluids and debris materials at the surface being cleaned by the cleaning apparatus 10 and/or by the tool. In this way, the surface being cleaned by the cleaning apparatus 10 may be the same or different than the surface to be cleaned by the tool. Moreover, the cleaning apparatus 10 may include a cord that engages a power outlet to receive power or may include a battery for powering the cleaning apparatus 10 and/or the tool.

Figure 3:
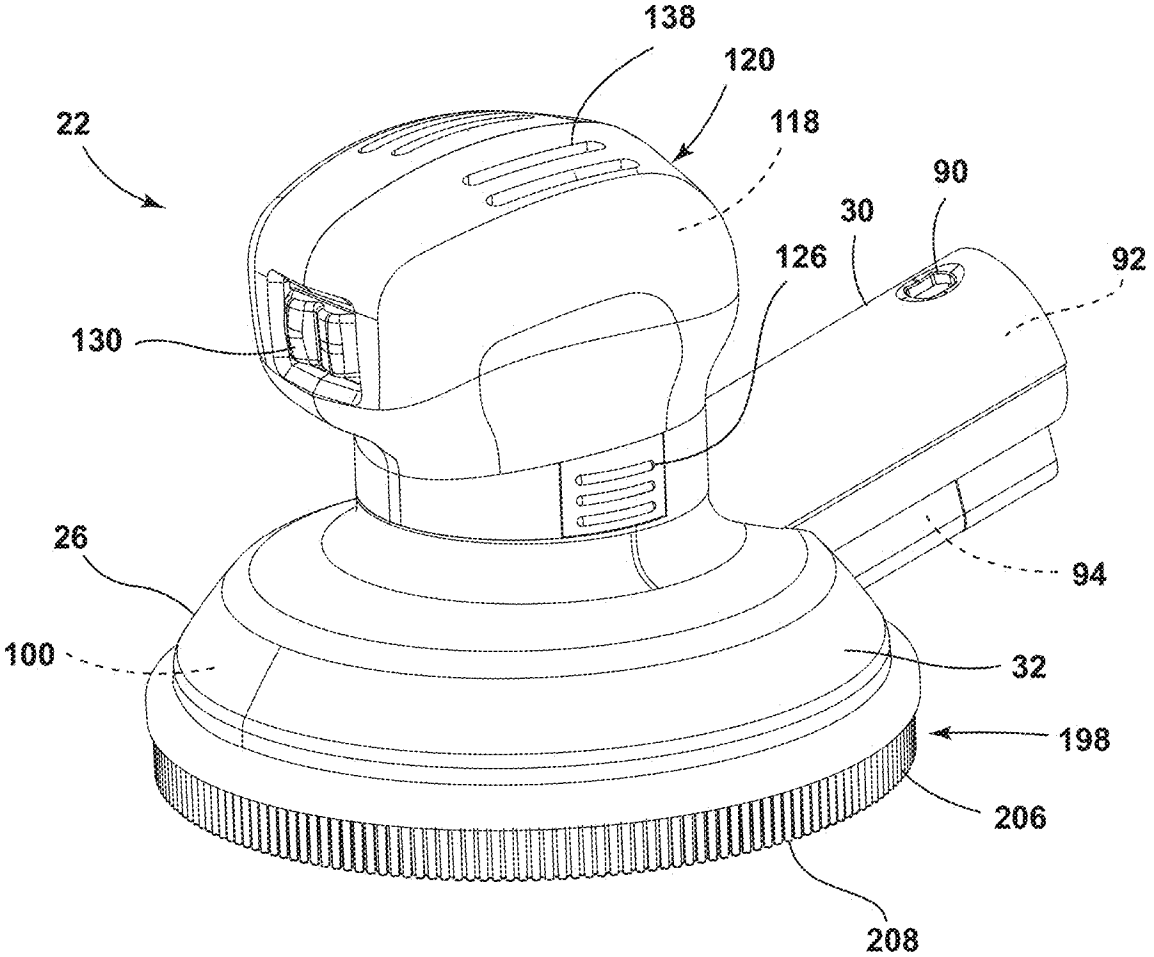
FIG. 3 is a side perspective view of a rotary scrubbing tool for use with a cleaning apparatus, according to the present disclosure.

Referring still to FIGS. 1 and 2, as well as FIG. 3, the cleaning apparatus 10, including any configuration of the portable or upright cleaning apparatuses 10, utilizes the fluid directing system with each of the suction assembly 14 and the liquid delivery system 16. When not used with the tool, the cleaning apparatus 10 uses the suction assembly 14 and the liquid delivery system 16 for various cleaning functions. The cleaning apparatus 10 may also be used with the tool selectively coupled with the cleaning apparatus 10 via the accessory hose 20. The tool, such as the rotary scrubbing tool 22, is generally manually maneuverable by the user relative to the cleaning apparatus 10.

The tool or accessory disclosed herein is configured as the rotary scrubbing tool 22. The rotary scrubbing tool 22 is configured to utilize various features and functions of the cleaning apparatus 10, including the suction assembly 14 and the liquid delivery system 16. When the rotary scrubbing tool 22 is used with the cleaning apparatus 10, the suction assembly 14 and the liquid delivery system 16 are utilized with the rotary scrubbing tool 22 separate from the functions of the cleaning apparatus 10. Accordingly, the cleaning apparatus 10 may include valves or similar features to direct the fluid to and from the rotary scrubbing tool 22, as well as to and from other locations of the cleaning apparatus 10 when the rotary scrubbing tool 22 is not coupled to the base housing 12.

The accessory hose 20 and the wand 18 provide fluid communication between the fluid directing system of the cleaning apparatus 10 and the rotary scrubbing tool 22. The wand 18 is coupled to a distal end of the accessory hose 20 and is configured to be inserted into the connector 30 of the support member 26 to couple the rotary scrubbing tool 22 to the wand 18. A specific alignment between the rotary scrubbing tool 22 and the wand 18 is advantageous for providing the fluid communication between the rotary scrubbing tool 22 and the suction assembly 14, as well as between the rotary scrubbing tool 22 and the liquid delivery system 16.

The wand 18 is configured to provide a grasping location for the user. The user may grasp the wand 18 and/or the connector 30 to move the rotary scrubbing tool 22 relative to the surface to be cleaned. It is also contemplated that the user may grasp the rotary scrubbing tool 22 and/or an auxiliary handle of the rotary scrubbing tool 22 without departing from the teachings herein. The user can move the rotary scrubbing tool 22 over the surface to be cleaned to collect, capture, or otherwise engage the debris materials from the surface to be cleaned and provide a cleaning function. Based on the configuration of the rotary scrubbing tool 22, the surface to be cleaned may be a horizontal surface, including a ceiling, or a non-horizontal surface.

Figure 4:
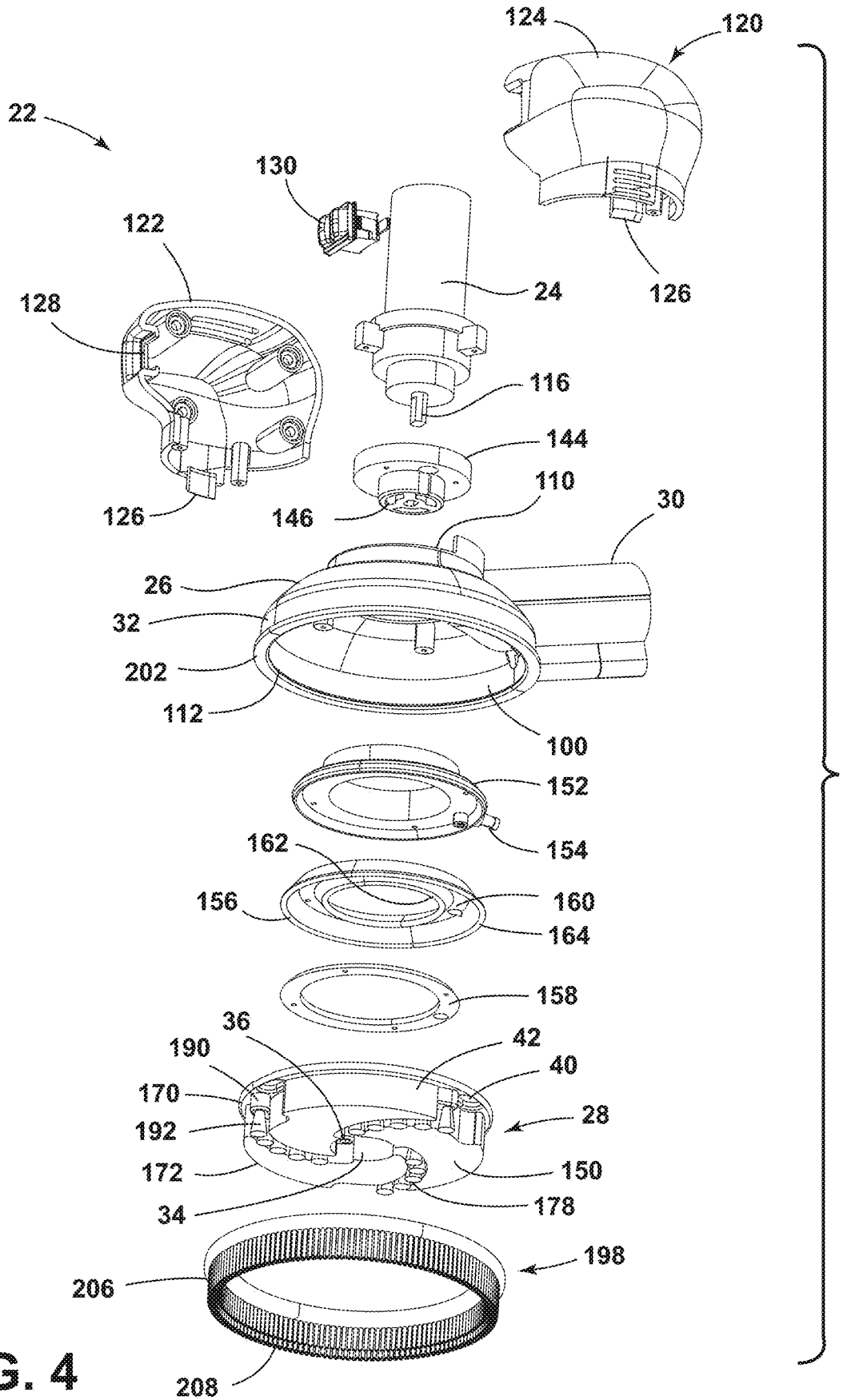
FIG. 4 is a side perspective exploded view of a rotary scrubbing tool for use with a cleaning apparatus, according to the present disclosure.
Figure 5:
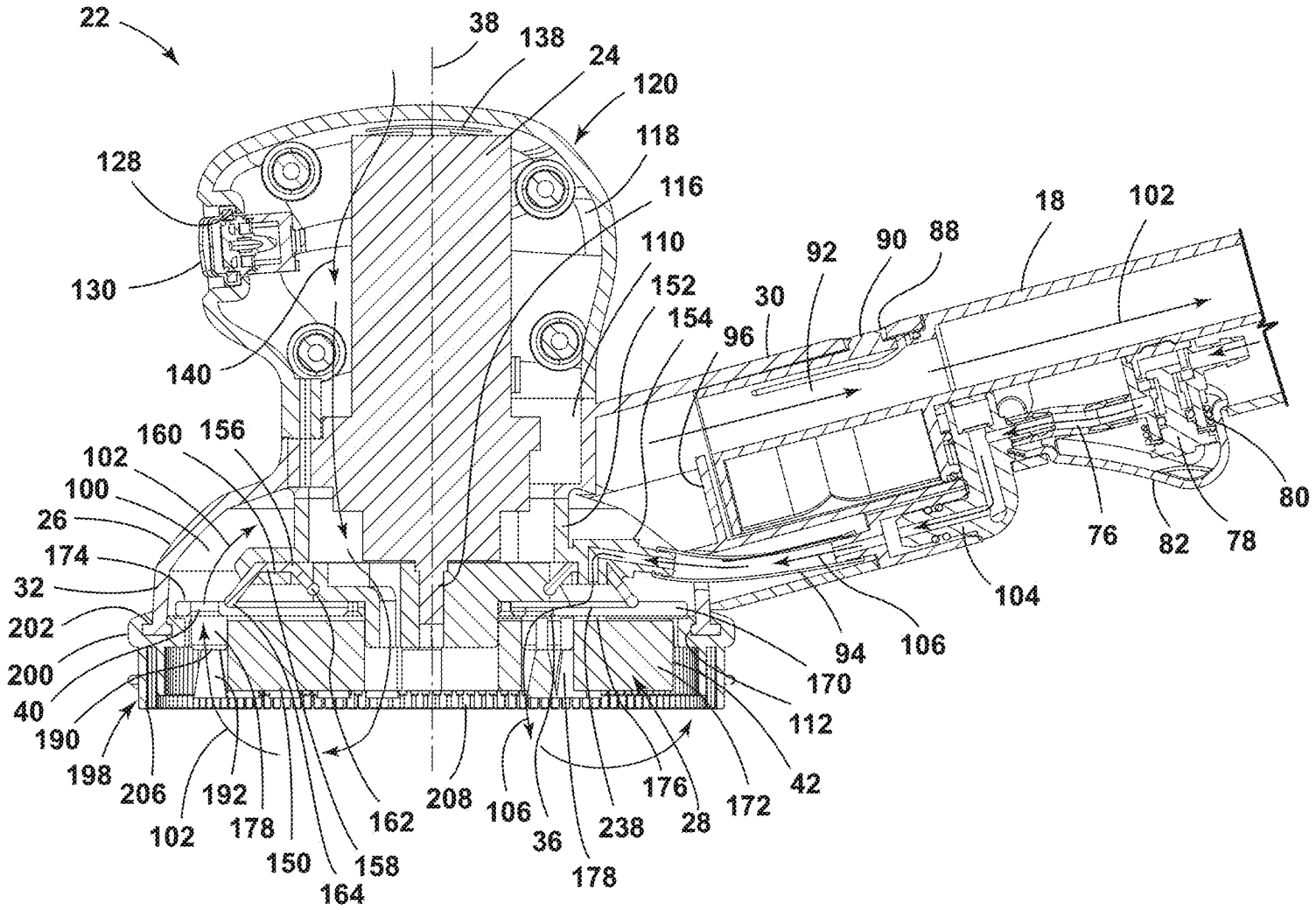
FIG. 5 is a cross-sectional view of a rotary scrubbing tool and a wand of a cleaning apparatus, according to the present disclosure.

Referring still to FIG. 3, as well as FIGS. 4 and 5, the wand 18 includes a conduit 76 for delivering the liquid from the liquid delivery system 16, which is selectively opened and closed via a valve 78. The valve 78 is operably coupled with a biasing member 80, which is illustrated as a coil spring. The biasing member 80 is configured to bias the valve 78 to a closed state, which prevents the liquid from flowing to the rotary scrubbing tool 22. The valve 78 is configured to be actuated upon force applied to an actuator, such as a trigger or button 82 on the wand 18. Adjustment of the button 82 into the wand 18 is configured to actuate the valve 78 to an opened state, providing fluid communication to the rotary scrubbing tool 22.

Accordingly, the liquid delivered to the rotary scrubbing tool 22 is controlled by the user. The user may depress the button 82 to actuate the valve 78 and open fluid communication at intervals, as needed, or to maintain open fluid communication and continually provide the liquid to the rotary scrubbing tool 22. In some configurations, liquid delivery through the rotary scrubbing tool 22 may be controlled by an actuator and fluid flow control system (e.g., a valve) carried by the rotary scrubbing tool 22. In additional or alternative configurations, liquid delivery through the rotary scrubbing tool 22 may be controlled by an electronically controlled fluid flow system that delivers liquid through the rotary scrubbing tool 22 based on mode selection (e.g., a spot cleaning mode) and/or based on sensor information (e.g., sensor information based on the degree of soiling of the surface being cleaned).

The rotary scrubbing tool 22 includes the support member 26 with the connector 30 and the guide 32. The connector 30 is configured to receive and couple to the wand 18. The wand 18 includes a detent 88 which is configured to be disposed within an aperture 90 defined by the connector 30 to selectively couple the rotary scrubbing tool 22 to the wand 18. The wand 18 is partially inserted into the support member 26 and moves the detent 88 into the aperture 90. The detent 88 may be moved or adjusted to allow for disengagement of the rotary scrubbing tool 22 from the wand 18, which may be advantageous for cleaning the rotary scrubbing tool 22 or selectively coupling a different accessory or tool to the wand 18.

The connector 30 includes two passageways 92, 94 for receiving portions of the wand 18. The first passageway 92 receives a distal end of the wand 18 and includes a stopper 96 for providing a limit to the insertion of the wand 18 into the first passageway 92. The first passageway 92 is in fluid communication with an interior 100 of the support member 26 and the wand 18 to form a portion of a fluid flow path 102 as described herein. The second passageway 94 receives a liquid delivery outlet 104 for the conduit 76. Liquid dispensed from the liquid delivery system 16 is configured to flow through the conduit 76 and into the second passageway 94 to be delivered to the pad base 28 as described herein. Accordingly, the conduit 76 and the second passageway 94 form a portion of a liquid flow path 106.

Referring still to FIGS. 3-5, the support member 26 includes the guide 32 coupled to the connector 30. The guide 32 forms a generally hemispherical shape defining the hollow interior 100 for receiving other portions of the rotary scrubbing tool 22. Each of the first and second passageways 92, 94 is in fluid communication with the interior 100 of the guide 32. The guide 32 includes a first end opening 110 and a second end opening 112, which are each central openings that are generally coaxial with one another. Based on the shape of the guide 32, the first end opening 110 is smaller than the second end opening 112.

The rotary scrubbing tool 22 includes the motor assembly 24 that extends through the first end opening 110 and into the interior 100 of the guide 32. The motor assembly 24 includes a motor, gears, and a drive connection 116. The motor assembly 24 is configured to drive the rotational motion of various features of the rotary scrubbing tool 22 about the rotational axis 38 of the rotary scrubbing tool 22.

With reference still to FIGS. 3-5, the motor assembly 24 is partially disposed within the interior 100 of the guide 32 and partially disposed within an interior 118 of a motor housing 120. The motor housing 120 includes two housing portions 122, 124, which couple together around the motor assembly 24. In the illustrated example, the motor housing 120 includes snap features 126, which are configured to snap engage with the guide 32 adjacent to the first end opening 110. The snap features 126 are configured to extend through the first end opening 110 and engage mating features on an inner surface of the guide 32 to couple the motor housing 120 to the guide 32. The snap features 126 may be elastically deformable components, allowing the user to press the snap features 126 to disengage the snap features 126 from the guide 32 and, ultimately, disengage the motor housing 120.

In the illustrated example, the motor housing 120 defines an aperture 128 configured to receive a power switch 130. The power switch 130 is in electrical communication with the motor assembly 24. In this way, the user can interact with the power switch 130 to control the motor assembly 24. In various examples, the power switch 130 may be utilized to activate and deactivate the motor assembly 24. In additional or alternative examples, the power switch 130 may also be utilized to adjust various settings of the motor assembly 24, such as speed. While the power switch 130 is illustrated as being carried by the rotary scrubbing tool 22, in some configurations, the power switch 130 may be carried by the cleaning apparatus 10 and the accessory hose 20 may carry electrical wiring electrically coupling the rotary scrubbing tool 22 with the cleaning apparatus 10.

Referring still to FIGS. 3-5, the motor housing 120 defines air vents 138 to provide fluid communication between the interior 118 of the motor housing 120 and an area external to the motor housing 120 (i.e., an area surrounding the rotary scrubbing tool 22). The air vents 138, the interior 118 of the motor housing 120, and the interior 100 of the guide 32 are in fluid communication with one another and define a portion of an airflow path 140 through the rotary scrubbing tool 22. The air vents 138 are defined on an end of the motor housing 120 and may be defined in additional or alternative locations on the motor housing 120 or the support member 26 without departing from the teachings herein.

Figure 6:
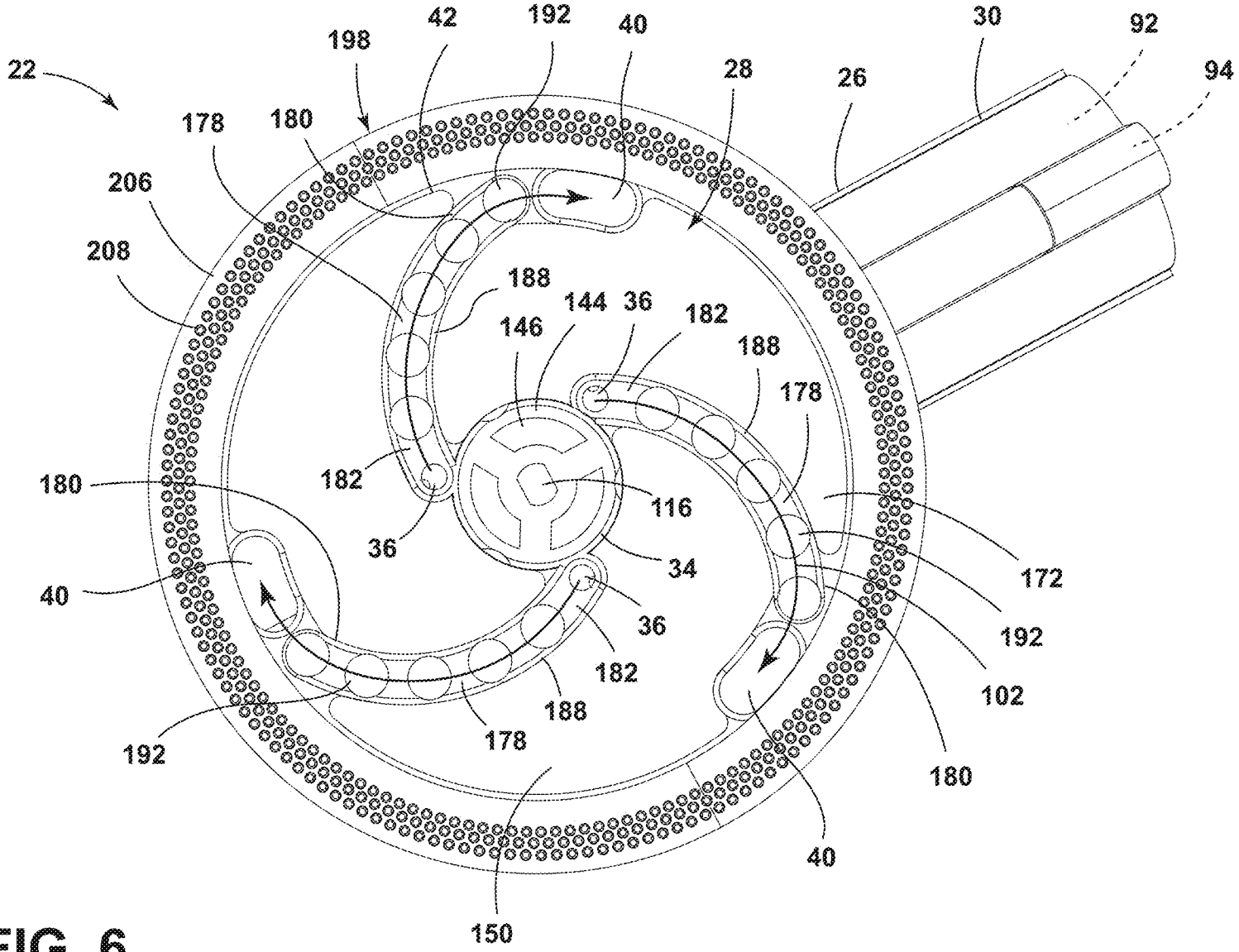
FIG. 6 is a bottom plan view of a rotary scrubbing tool with inner bristles disposed in fluid flow channels and a peripheral seal having outer bristles, according to the present disclosure.

With reference still to FIGS. 4 and 5, as well as FIG. 6, the rotary scrubbing tool 22 includes a connecting hub 144 disposed within the interior 100 of the guide 32. The connecting hub 144 is coupled to the drive connection 116 of the motor assembly 24 and to the pad base 28. Generally, the connecting hub 144 is disposed within or extends into a central opening of the pad base 28 that forms the air outlet 34. The connecting hub 144 defines airflow channels 146 that fluidly couple the interiors 100, 118 of the guide 32 and the motor housing 120 with a space on an opposing side of the pad base 28 adjacent to a cleaning or outer surface 150 of the pad base 28. The airflow channels 146 align with the central opening of the pad base 28 to form the air outlet 34. The air outlet 34 may be a single outlet or configured as multiple outlets based on the configuration of the pad base 28 and the connecting hub 144. The connecting hub 144 may operate to guide the air through the pad base 28 to be used for the cleaning process.

The rotary scrubbing tool 22 includes components for directing the liquid to the pad base 28 for the cleaning process. For example, a fluid ring 152 is disposed within the interior 100 of the guide 32 and is coupled to the guide 32 proximate to the first end opening 110. The fluid ring 152 includes a liquid inlet 154 that extends at least partially into the second passageway 94 of the connector 30. The liquid inlet 154 is configured to receive the liquid from the wand 18 and guide the liquid to the pad base 28. The fluid ring 152 generally forms an annular or ring shape extending about the motor assembly 24 and the connecting hub 144.

The liquid inlet 154 of the fluid ring 152 extends through a sealing feature 156 and a seal retainer 158 disposed between the fluid ring 152 and the pad base 28. The sealing feature 156 defines an annular or ring shape with a central opening for the motor assembly 24 and the connecting hub 144. The sealing feature 156 abuts the fluid ring 152 and extends adjacent to or abuts the pad base 28. The sealing feature 156 has an abutting portion 160 and sidewalls 162, 164 that extend an obtuse angle in opposing directions from the abutting portion 160. The sealing feature 156 provides a generally sealed space or sealed portion of the liquid flow path 106 between the fluid ring 152 and the pad base 28 for guiding the liquid from the liquid inlet 154 to the pad base 28. This sealed space is advantageous for containing the liquid in the rotary scrubbing tool 22 in the liquid flow path 106.

The seal retainer 158 is disposed adjacent to the abutting portion 160 of the sealing feature 156 between the sidewalls 162, 164. The seal retainer 158 may be configured to assist in retaining the fluid ring 152 and the sealing feature 156 in position relative to one another. Further, the liquid inlet 154 of the fluid ring 152 extends through the seal retainer 158.

With reference still to FIGS. 4-6, the rotary scrubbing tool 22 includes the pad base 28, which is coupled to the connecting hub 144 and extends through the second end opening 112 of the guide 32. The pad base 28 includes a support plate 170 and a surface treating element 172, such as a scrubber pad 172. The surface treating element 172 can include any suitable material or combinations of materials for treating a surface, non-limiting examples of which include, a scrubbing pad, an absorbent material, a buffing material, agitation elements, bristles, abrasive materials, microfiber, etc. The support plate 170 is operably coupled to the connecting hub 144 to assist with translating the rotational movement to the scrubber pad 172. The support plate 170 has an interior surface 174 oriented toward the interior 100 of the guide 32 and an exterior surface 176 on which the scrubber pad 172 is coupled. Generally, the scrubber pad 172 is constructed of a closed cell foam material. The closed cell foam material may be advantageous for softening when wet and not retaining significant quantities of liquid. The scrubber pad 172 may be a single component or multiple components coupled to the support plate 170 in a specific arrangement.

In the illustrated example, the pad base 28 defines the air outlet 34 at or adjacent to the rotational axis 38. The pad base 28 defines a plurality of fluid flow channels 178 that extend from the central air outlet 34 toward or to the peripheral edge 42 of the scrubber pad 172. In this way, the fluid flow channels 178 extend across the scrubber pad 172 and radially outward from the air outlet 34. Moreover, the fluid flow channels 178 may extend an entire depth of the scrubber pad 172, extending from the support plate 170 and through the outer surface 150 of the scrubber pad 172. However, shallower fluid flow channels 178 may be utilized without departing from the teachings herein. Generally, the fluid flow channels 178 define arc shapes, which curve in a same direction. The curved and arced configuration of the fluid flow channels 178 may be advantageous for guiding fluid along the fluid flow channels 178 and toward the peripheral edge 42 as the pad base 28 rotates.

The pad base 28 defines the fluid inlets 40 adjacent to the peripheral edge 42 of the pad base 28 and at a distal end 180 of each flow channel 178. The fluid inlets 40 may be defined by the support plate 170, the scrubber pad 172, or both depending on the configuration of the pad base 28. The air outlet 34 and the liquid outlets 36 are defined at or proximate to proximal ends 182 of the fluid flow channels 178, and the fluid inlets 40 are defined at or proximate to the opposing distal ends 180 of the fluid flow channels 178. The liquid outlets 36 are defined adjacent to the air outlet 34 and are generally arranged around the air outlet 34, which causes the air to flow over the liquid outlets 36 to guide dispensed liquid across the pad base 28 as described herein. In the illustrated configuration, each flow channel 178 aligns with one liquid outlet 36 and one fluid inlet 40. One or both of the liquid outlets 36 and the fluid inlets 40 may be defined within the fluid flow channels 178, respectively. It is also contemplated that more than one liquid outlet 36 and/or more than one fluid inlet 40 may be defined in each fluid flow channel 178. Additionally or alternatively, one or both of the liquid outlets 36 and the fluid inlets 40 may be defined adjacent or proximate to ends 180, 182 of the fluid flow channels 178.

With reference still to FIGS. 4-6, as illustrated, the support plate 170 defines elongated projections 188, which extend into the fluid flow channels 178. The elongated projections 188 extend along a substantial portion or the entirety of each flow channel 178. As illustrated in FIG. 6, the elongated projections 188 also define the liquid outlets 36. Additionally, the elongated projections 188 define apertures 190 spaced apart along a length thereof. Inner bristles 192 are disposed in the apertures 190 and coupled to the support plate 170. Accordingly, each flow channel 178 includes the inner bristles 192 spaced apart along a length thereof. In this way, each flow channel 178 includes multiple inner bristles 192 arranged in a side-by-side configuration from the proximal end 182 to the distal end 180.

The inner bristles 192 generally extend beyond the outer surface 150 of the pad base 28 for engaging the surface to be cleaned. The inner bristles 192 may be constructed of any practicable material, such as foams, rubbers, nylons, polymers, etc., which may be chosen based on the type of surface to be cleaned. Further, the inner bristles 192 may be elastically deformable to provide a scrubbing or cleaning function when the rotary scrubbing tool 22 is in use against the surface to be cleaned. The pad base 28 may also be utilized without the inner bristles 192 without departing from the teachings herein.

Referring still to FIGS. 4-6, the pad base 28 is a rotating feature of the rotary scrubbing tool 22 to provide the cleaning function. Accordingly, the connecting hub 144 and the pad base 28, including the support plate 170, the scrubber pad 172, and the inner bristles 192, are driven to rotate by the motor assembly 24.

The rotary scrubbing tool 22 may also include a peripheral gasket or peripheral seal 198. The peripheral seal 198 extends proximate to the peripheral edge 42 of the pad base 28, generally encircling or surrounding the pad base 28. The peripheral seal 198 is coupled to the guide 32 and, accordingly, does not rotate with the pad base 28. The peripheral seal 198 includes a receiving portion 200, which is configured to engage an edge 202 of the guide 32 that defines the second end opening 112. Generally, the peripheral seal 198 is constructed of an elastomeric material, such as rubber or silicone. In such examples, the receiving portion 200 is configured to elastically deform to receive and retain the edge 202 of the guide 32.

In the configuration illustrated in FIGS. 4-6, the peripheral seal 198 is illustrated as a scrubber skirt 206. The scrubber skirt 206 includes outer bristles 208 arranged in multiple concentric rings. The outer bristles 208 are generally constructed of an elastomeric material and are configured to act as a seal around the pad base 28. The outer bristles 208 are generally narrower and spaced closely together to form the seal. Additionally, as illustrated, the ring of outer bristles 208 closest to the scrubber pad 172 is shorter compared to the remaining rings of outer bristles 208 to assist with forming a seal on uneven surfaces.

Figure 7:
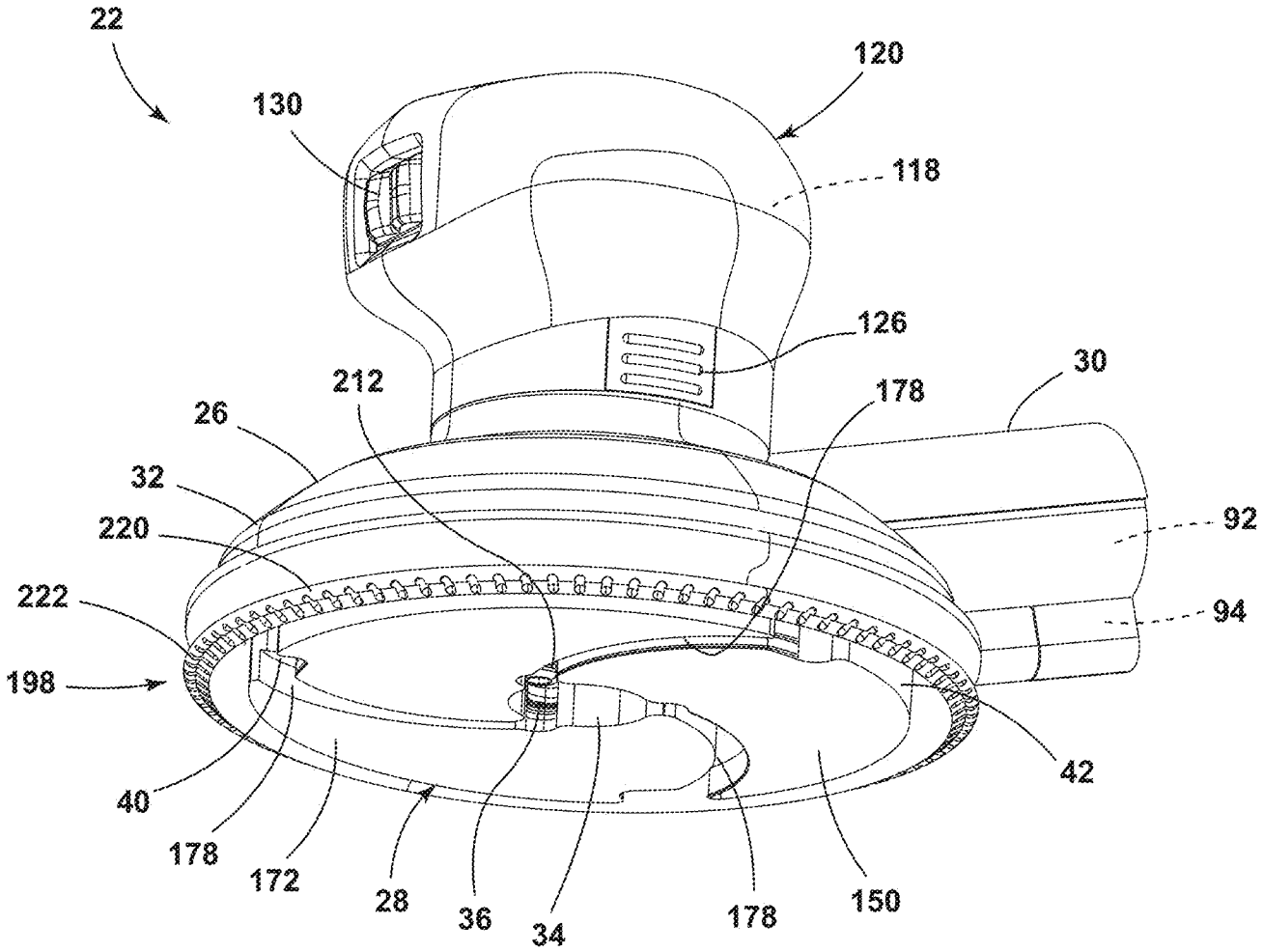
FIG. 7 is a side perspective view of a rotary scrubbing tool for a cleaning apparatus, where the rotary scrubbing tool includes a ribbed peripheral seal, according to the present disclosure.
Figure 8:
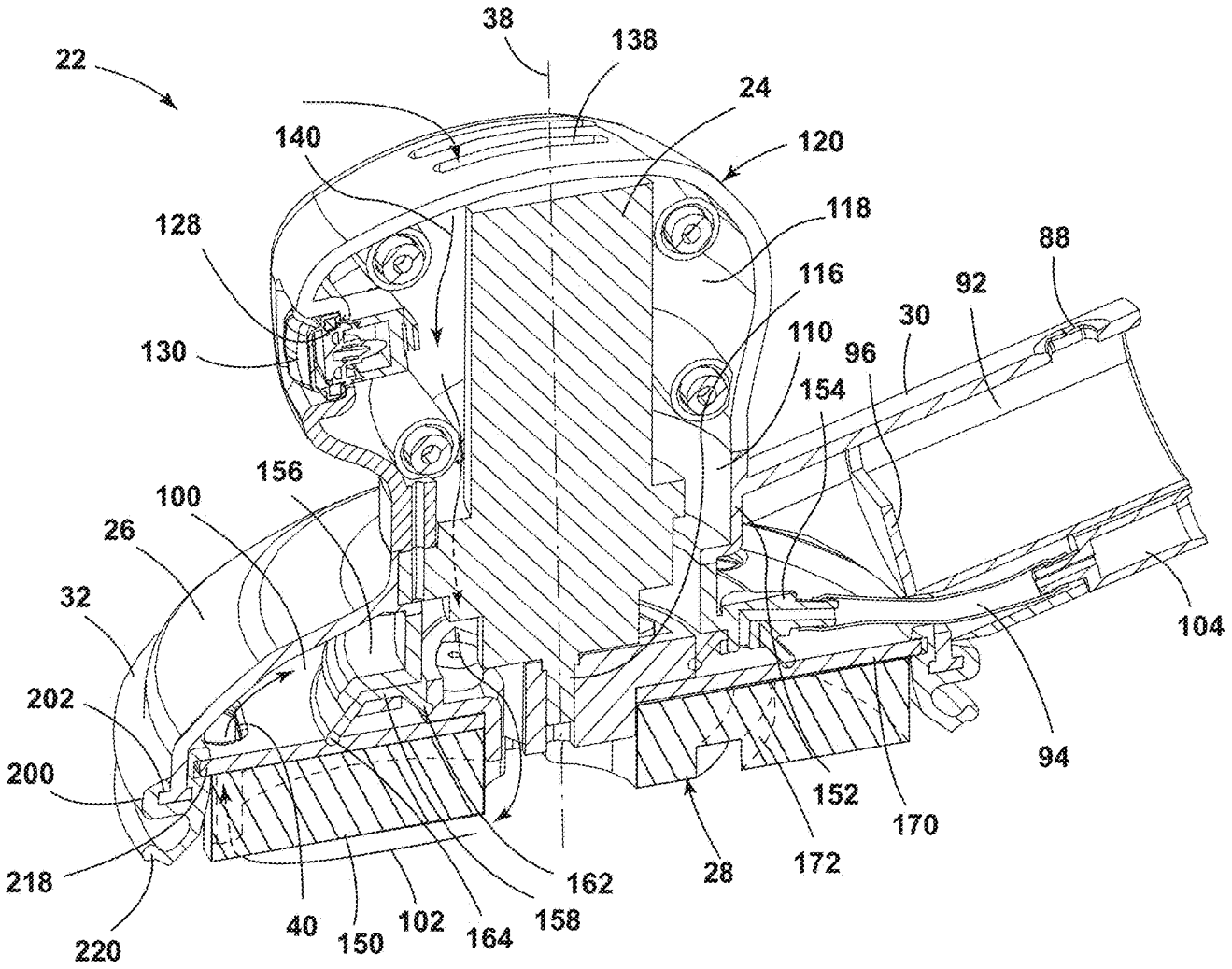
FIG. 8 is a cross-sectional view of a rotary scrubbing tool with shallow fluid flow channels and a peripheral seal, according to the present disclosure.
Figure 9:
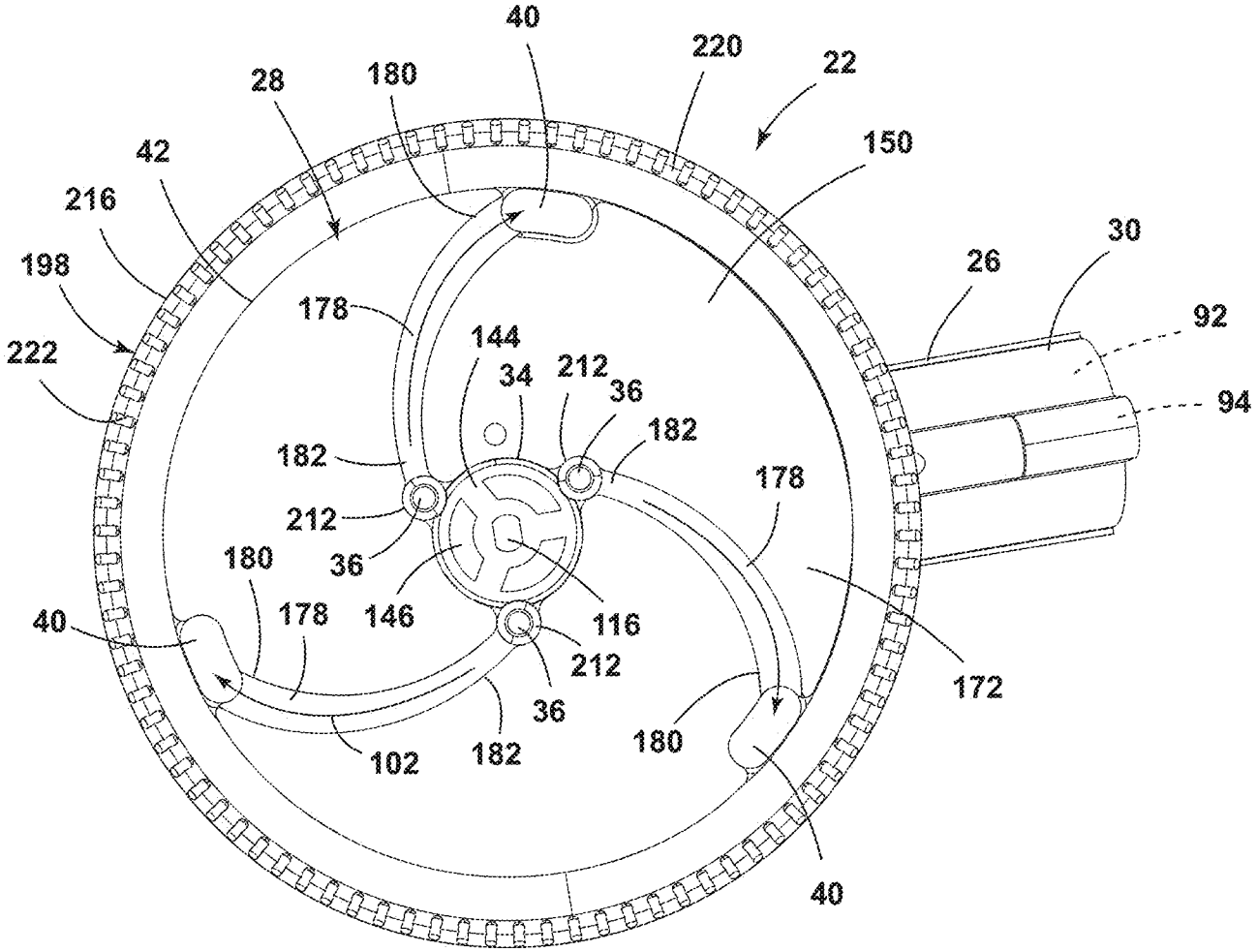
FIG. 9 is a bottom plan view of a rotary scrubbing tool with fluid flow paths and a ribbed peripheral seal, according to the present disclosure.

With reference to FIGS. 7-9, the pad base 28 and the peripheral seal 198 may have different configurations, which may be determined by the type of surface to be cleaned, the type of debris materials to be cleaned, or the cleaning process. For example, the rotary scrubbing tool 22 may be utilized for a variety of hard surfaces such as floors, wood, tiles, glasses, etc. In the illustrated example in FIGS. 7-9, the scrubber pad 172 is a single component defining the fluid flow channels 178, where the fluid flow channels 178 extend from the outer surface 150 of the scrubber pad 172 and toward the support plate 170 for a portion of the depth of the scrubber pad 172. Accordingly, the fluid flow channels 178 are shallower and do not extend to the support plate 170. Further, in such configurations, the inner bristles 192 may be omitted.

The support plate 170 may define outlet projections 212 extending partially through the scrubber pad 172. In various examples, the outlet projections 212 define the liquid outlets 36 and may not be elongated to extend along the fluid flow channels 178. The outlet projections 212 defining the liquid outlets 36 may assist in directing the liquid into the shallower fluid flow channels 178.

Referring still to FIGS. 7-9, the peripheral seal 198 is configured as a ribbed scrubber 216. The ribbed scrubber 216 is constructed of elastomeric material and is configured to deform in response to force against the surface being cleaned. The ribbed scrubber 216 is configured to extend partially into the interior 100 of the guide 32. In such examples, the ribbed scrubber 216 may define an annular groove 218 oriented toward the support plate 170. The support plate 170 is configured to rotate within the annular groove 218. This configuration may provide for an increased seal along an edge of the support plate 170.

A contact surface 220 is generally bent, folded, or arced and configured to deform when pressed against the surface being cleaned to provide a seal about the pad base 28. The contact surface 220 may generally align with the outer surface 150 of the scrubber pad 172. The contact surface 220 of the ribbed scrubber 216 defines ribs 222 that are spaced apart from one another. The ribs 222 may protrude relative to the contact surface 220 or be recessed forming notched ribs 222 or grooves. The ribs 222 are generally integrally formed with the ribbed scrubber 216 and are oriented radially about the pad base 28. The ribbed scrubber 216 is configured to act as a loose seal around the pad base 28, permitting airflow due to the configuration of the ribs 222. Moreover, the ribbed scrubber 216 may be advantageous for providing a squeegee-like effect with the ribs 222. Accordingly, the ribbed scrubber 216 may be advantageous for cleaning glass surfaces.

Figure 10:
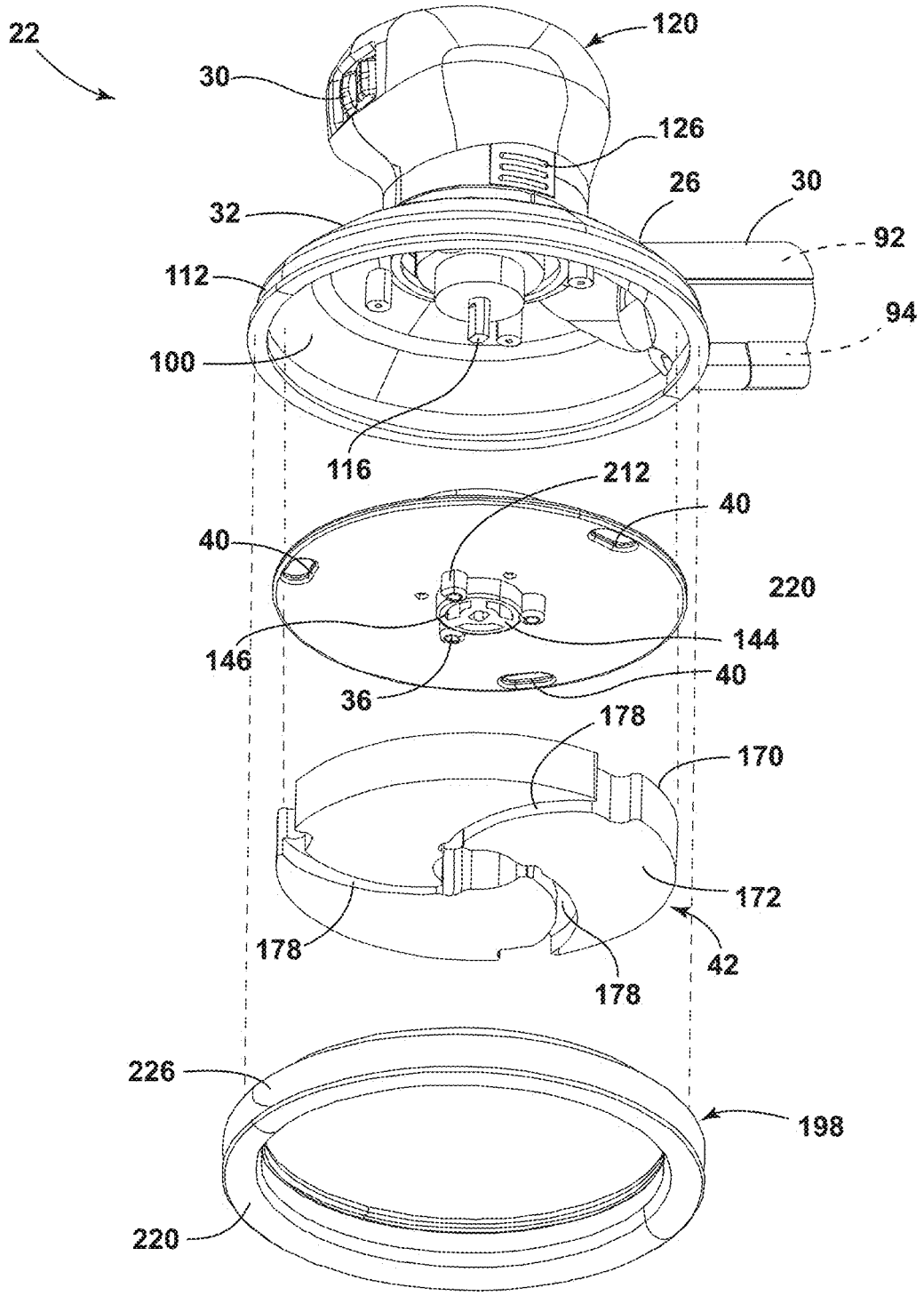
FIG. 10 is a partially exploded, side perspective view of a rotary scrubbing tool with a smooth peripheral seal, according to the present disclosure.
Figure 11:
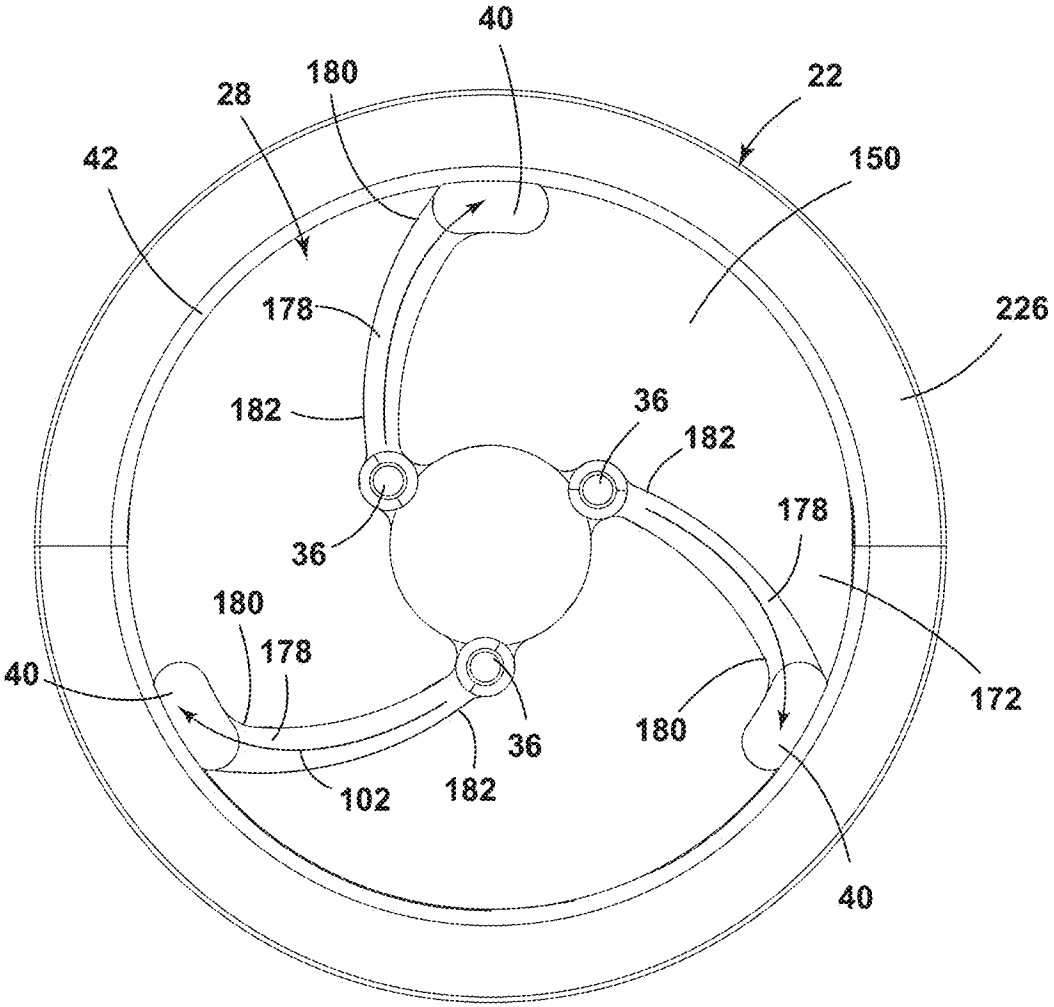
FIG. 11 is a bottom plan view of a rotary scrubbing tool with fluid flow paths and a smooth peripheral seal, according to the present disclosure.

With reference to FIGS. 10 and 11, in additional or alternative configurations, the peripheral seal 198 may be configured as a smooth scrubber 226, which may be substantially similar to the ribbed scrubber 216 disclosed in FIGS. 7-9. In comparison, the smooth scrubber 226 illustrated in FIGS. 10 and 11 has a smooth contact surface 220 where the ribs 222 are omitted. The smooth contact surface 220 generally defines an arc or bent, folded, or arced shape, which is configured to deform against the surface being cleaned to maximize the surface area of the contact surface 220 engaging the surface being cleaned. The smooth scrubber 226 may provide cleaning functionality with an increased seal around the pad base 28. Accordingly, the smooth scrubber 226 may be advantageous for cleaning more vertical or ceiling-like surfaces.

Figure 12:
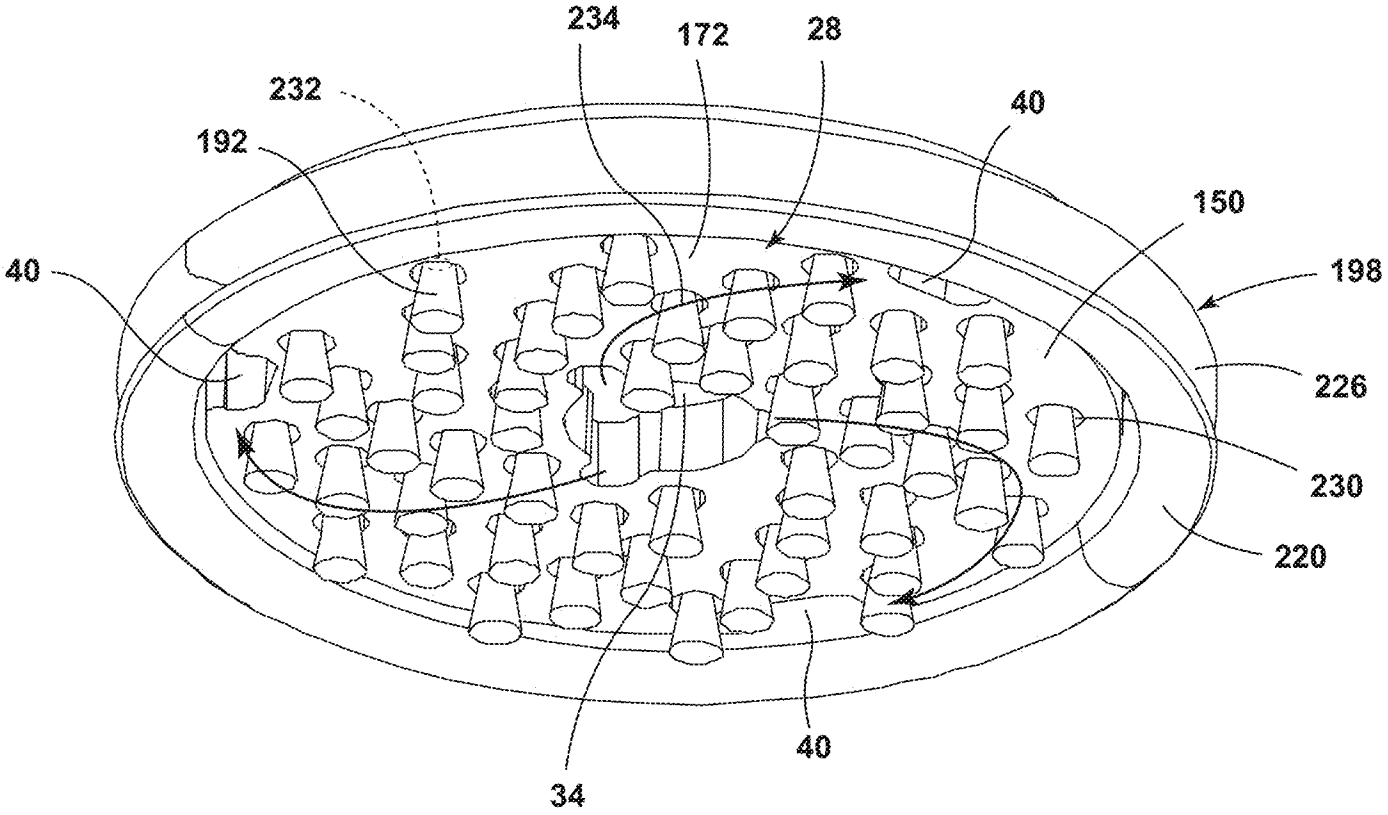
FIG. 12 is a bottom perspective view of a smooth peripheral seal and a pad base for a rotary scrubbing tool, where the pad base defined apertures through which inner bristles extend, according to the present disclosure.

With reference to FIG. 12, the scrubber pad 172 may have an additional or alternative configuration where the fluid flow channels 178 are omitted. In such examples, the scrubber pad 172 defines a plurality of apertures 230 in a select pattern across the scrubber pad 172. The apertures 230 extend through the scrubber pad 172, from the support plate 170, and through the outer surface 150. The support plate 170 defines coupling projections 232 that extend into each aperture 230. Additionally, the pad base 28 includes the inner bristles 192 coupled to the coupling projections 232 and extending through the aperture 230. The inner bristles 192 extend beyond the outer surface 150 of the scrubber pad 172.

Generally, the inner bristles 192 are arranged to form surface flow paths 234 across the outer surface 150 of the pad base 28. The inner bristles 192 are arranged in side-by-side configurations in arced or curved patterns, similar to the arrangement of the fluid flow channels 178 in FIG. 6. The pattern of the inner bristles 192 forms the surface flow paths 234 between the arced shapes formed by the inner bristles 192 to guide fluid across the scrubber pad 172 and to the fluid inlets 40. Generally, the liquid outlets 36 and fluid inlets 40 are arranged at opposing ends of the surface flow paths 234 formed by the inner bristles 192.

With reference to FIGS. 1-12, the different configurations of the pad base 28 and the peripheral seal 198 may be used in any combination. Accordingly, any configuration of the pad base 28 may be used with any configuration of the peripheral seal 198. Further, the peripheral seal 198 may be interchanged to provide different cleaning and sealing functions.

In operation, the user is configured to insert the wand 18 into the connector 30 to couple the rotary scrubbing tool 22 with the cleaning apparatus 10. The user may then activate the rotary scrubbing tool 22 through the power switch 130, which consequently activates the motor assembly 24. The motor assembly 24 is configured to drive the rotational motion of the pad base 28 about the rotational axis 38. In this way, the pad base 28 with the surface treating element 172 and the inner bristles 192 may provide a rotational cleaning function on the surface to be cleaned while the peripheral seal 198 remains stationary to provide an outer seal. Moreover, the pad base 28 can support any type of cleaning implement, including agitators, bristles, buffing pads, cleaning material, absorbent material, abrasive material, combinations, etc. to provide additional or alternative cleaning functions.

The rotary scrubbing tool 22 is configured to utilize both air and liquid for the cleaning process, as well as for minimizing wet spots and excess liquid. The rotary scrubbing tool 22 may utilize airflow to disperse and control the dispensed liquid. The liquid from the liquid delivery system 16 is introduced into the rotary scrubbing tool 22 via the opening of the valve 78 by depressing the button 82. The liquid flows through the wand 18 and into the connector 30. The liquid then flows through the fluid ring 152 and through the liquid outlets 36. Accordingly, the liquid flow path 106 is defined from the liquid delivery system 16, through the accessory hose 20, through the wand 18, through the support member 26, and through the liquid outlets 36.

The rotation of the pad base 28 allows the liquid to be dispensed from one liquid inlet 154 and through multiple liquid outlets 36. Further, the support plate 170 may define recessed regions 238 in the interior surface 174 to capture and guide the liquid to the liquid outlets 36. The liquid is dispensed from the liquid outlets 36 proximate to the rotational axis 38 and into the fluid flow channels 178 or the surface flow paths 234 based on the configuration of the pad base 28. The liquid is dispensed on the surface to be cleaned for the cleaning process.

The liquid delivery system 16 is configured to operate in conjunction with the suction assembly 14. The suction assembly 14 provides the vacuum effect to vacuum fluid away from the surface being cleaned. This vacuum effect is generated when the outer surface 150 of the surface treating element 172 is engaged with the surface being cleaned, forming the fluid flow paths 102 through or across the pad base 28. Once the rotary scrubbing tool 22 engages the surface to be cleaned, the air is drawn through the air vents 138 of the motor housing 120, through the interior 100 of the guide 32, through the connecting hub 144, and through the air outlet 34. Accordingly, the airflow path 140 is defined from the air vents 138, through the guide 32, and through the pad base 28.

Due to the vacuum effect, the air flowing through the air outlet 34 is drawn through the fluid flow channels 178 or the surface flow paths 234 and toward the fluid inlets 40 at the peripheral edge 42. As the air is drawn across the pad base 28, the air is drawn over the liquid outlets 36. Accordingly, as the air is drawn across the liquid outlets 36, the air pulls the dispensed liquid across the pad base 28 toward the peripheral edge 42. In this way, the airflow generated by the suction assembly 14 assists in dispersing the liquid for the cleaning process, which also assists in minimizing wet spots from the dispensed liquid.

The air and the liquid flow together from the central rotational axis 38 along the combined fluid flow path 102 and through the fluid inlets 40 at the peripheral edge 42. Accordingly, the fluid flow path 102 directs both air and liquid outward and across the pad base 28. In examples with the inner bristles 192, the fluid is directed around or through the inner bristles 192 to the fluid inlets 40. The air and the liquid are then drawn into the interior 100 of the guide 32, through the connector 30, through the wand 18, and to the cleaning apparatus 10. Overall, the air and the liquid exit the rotary scrubbing tool 22 at a central location of the pad base 28, and are dispersed outward, radially to the peripheral edge 42.

The airflow is configured to direct the liquid across the pad base 28 to increase the efficiency of the rotary scrubbing tool 22 as well as more evenly distribute the liquid for the cleaning process, thereby reducing wet spots and/or over-wetting of the surface. The liquid is configured to be extracted as the liquid is distributed across the pad base 28. Moreover, the airflow as well as the peripheral seal 198 may reduce or eliminate liquid that drips away from the rotary scrubbing tool 22. The cleaning process may be generally contained within the peripheral seal 198. In this way, the rotary scrubbing tool 22 may be utilized on non-horizontal surfaces (e.g., walls and windows) and horizontal surfaces, including ceilings, with minimal liquid dripping outside of the rotary scrubbing tool 22.

In various aspects, to provide a greater suction effect for the cleaning process, the user may cover the air vents 138 to reduce or prevent airflow into the rotary scrubbing tool 22. This increase in the suction effect may be advantageous for providing a more rigorous cleaning process or function to the surface to be cleaned. This suction effect may also assist in collecting dispensed liquid or liquid messes via the suction assembly 14. While the air vents 138 are illustrated as being open unless covered by a user's hand, in some configurations, a damper system may be provided to selectively close the air vents 138, which may be activated by the user or automatically based on a cleaning mode.

Use of the present device may provide for a variety of advantages. For example, the rotary scrubbing tool 22 may utilize liquid dispensed from the cleaning apparatus 10 for use in the cleaning process and provide the vacuum effect for drawing the dispensed liquid to the cleaning apparatus 10, providing fluid delivery and extraction with the single tool. Further, the use of the airflow is configured to disperse and control the liquid across the pad base 28 to more evenly distribute the liquid for the cleaning process. Additionally, the rotary scrubbing tool 22 may include the peripheral seal 198, which is configured to provide an outer seal about the pad base 28 to assist with capturing and retaining the dispensed liquid. Also, the configuration of the rotating scrubber pad 172 with the air-guided liquid and the peripheral seal 198 provides a more contained or sealed assembly, such that the rotary scrubbing tool 22 may be utilized on more vertical surfaces (e.g., walls, windows, etc.) or ceiling surfaces. Additional benefits and advantages may be realized and/or achieved.

The device disclosed herein is further summarized in the following paragraphs and is further characterized by combinations of any and all various aspects described herein.

According to another aspect of the present disclosure, a cleaning apparatus includes a housing, a suction assembly, and a liquid delivery system. A wand is in fluid communication with the suction assembly and the liquid delivery system via an accessory hose. A rotary scrubbing tool is selectively coupled to the wand. The rotary scrubbing tool includes a motor assembly. A support member includes a connector and a guide. The connector is configured to couple to the wand. A pad base is operably coupled to the motor assembly within an interior of the guide for driving rotation of the pad base. The pad base defines an air outlet and a liquid outlet proximate to a central rotational axis and a fluid inlet proximate to a peripheral edge of the pad base. The suction assembly directs air through the air outlet, across the pad base, and through the fluid inlet. Liquid dispensed from the liquid delivery system via the liquid outlet is directed across the pad base and through the fluid inlet by the suction assembly.

According to another aspect of the present disclosure, a wand includes an actuator and a valve. The actuator is configured to open the valve to provide fluid communication between a liquid delivery system and a rotary scrubbing tool.

According to another aspect of the present disclosure, a rotary scrubbing tool further includes a motor housing coupled with a guide of a support member. The motor assembly is at least partially disposed within the motor housing.

According to another aspect of the present disclosure, a motor housing defines air vents for air to be directed into a rotary scrubbing tool and through an air outlet.

According to another aspect of the present disclosure, a recovery container is operably coupled to a base housing. Air and liquid are directed toward the recovery container via an accessory hose and a suction assembly.

According to another aspect of the present disclosure, a rotary scrubbing tool defines a fluid flow path across a pad base along which air and liquid are directed. The rotary scrubbing tool includes a plurality of inner bristles disposed along the fluid flow path.

According to another aspect of the present disclosure, a rotary scrubbing tool further includes a peripheral seal coupled to a guide, where the peripheral seal extends proximate to a peripheral edge of a pad base.

According to another aspect of the present disclosure, a peripheral seal extends beyond an outer surface of a pad base to form a seal around the pad base with a surface to be cleaned. According to another aspect of the present disclosure, a rotary scrubbing tool further includes a fluid ring coupled to a guide of a support member and configured to direct liquid from a connector to a pad base.

According to another aspect of the present disclosure, a rotary scrubbing tool includes a sealing feature coupled to a fluid ring, where the sealing feature extends to a pad base to form a sealed liquid flow path over the pad base.

According to another aspect of the present disclosure, a guide defines a central opening. A motor assembly extends through the central opening to operably engage with a pad base.

According to another aspect of the present disclosure, a rotary scrubbing tool for a cleaning apparatus where the cleaning apparatus has a liquid delivery system and a suction assembly, and the rotary scrubbing tool includes a motor housing. A motor assembly is operably coupled with the motor housing. A support member includes a connector for engaging a wand of said cleaning apparatus and a guide coupled to the motor housing. A pad base is operably coupled to the motor assembly within an interior of the guide to drive rotation of the pad base. The pad base defines an air outlet proximate to a central rotational axis, a plurality of liquid outlets adjacent to the air outlet, and a plurality of fluid flow channels extending from the air outlet to proximate to a peripheral edge of the pad base. The plurality of liquid outlets is defined in the plurality of fluid flow channels. The pad base also defines at least one fluid inlet in each of the plurality of fluid flow channels and adjacent to the peripheral edge. Liquid from said liquid delivery system is configured to be dispensed through the plurality of liquid outlets. An airflow generated by said suction assembly is configured to be directed through the air outlet, along the plurality of fluid flow channels, and through the plurality of fluid inlets, where the airflow configured to distribute the liquid in the plurality of fluid flow channels and across the pad base.

According to another aspect of the present disclosure, a plurality of liquid outlets is arranged around an air outlet.

According to another aspect of the present disclosure, a pad base includes a support plate and a scrubber pad coupled to the support plate. Each channel of a plurality of fluid flow channels extends from an outer surface of the scrubber pad to the support plate.

According to another aspect of the present disclosure, a pad base includes a plurality of inner bristles disposed in a plurality of fluid flow channels and coupled to a support plate. According to another aspect of the present disclosure, a plurality of inner bristles extends beyond an outer surface of a scrubber pad.

According to another aspect of the present disclosure, a peripheral seal is coupled to a guide and extends proximate to a peripheral edge of a pad base.

According to another aspect of the present disclosure, a peripheral seal includes a plurality of outer bristles that extend beyond an outer surface of a pad base to form an outer seal when engaged with a surface to be cleaned.

According to another aspect of the present disclosure, a connecting hub is operably coupled to a motor assembly and a pad base for translating rotation from the motor assembly to the pad base.

According to another aspect of the present disclosure, a connecting hub defines airflow channels for airflow to be directed from an interior of a motor housing, through the airflow channels, and through an air outlet.

According to another aspect of the present disclosure, each fluid flow channel of a plurality of fluid flow channels defines an arced shape.

According to another aspect of the present disclosure, a rotary scrubbing tool for a cleaning apparatus where the cleaning apparatus has a liquid delivery system and a suction assembly, and the rotary scrubbing tool includes a motor housing defining air vents. A motor assembly is operably coupled with the motor housing. A support member includes a connector for engaging a wand of said cleaning apparatus and a guide coupled to the motor housing. A pad base is operably coupled to the motor assembly within an interior of the guide to drive rotation of the pad base. The pad base defines an air outlet proximate to a central rotational axis, at least one fluid flow channel extends from the air outlet to a peripheral edge of the pad base, at least one liquid outlet proximate to the air outlet is in the at least one fluid flow channel and at least one fluid inlet is proximate to the peripheral edge in the at least one fluid flow channel. A fluid flow path is defined across the pad base from the air outlet, through the at least one fluid flow channel, and to the at least one fluid inlet. Liquid is dispensed from the at least one liquid outlet and distributed across the pad base by air flowing along the fluid flow path.

According to another aspect of the present disclosure, at least one liquid outlet includes a plurality of liquid outlets arranged around an air outlet, at least one fluid flow channel includes a plurality of fluid flow channels arranged around an air outlet, and at least one fluid inlet includes a plurality of fluid inlets arranged along a peripheral edge of a pad base.

According to another aspect of the present disclosure, at least one liquid outlet includes a plurality of liquid outlets arranged around an air outlet.

According to another aspect of the present disclosure, at least one fluid flow channel includes a plurality of fluid flow channels arranged around an air outlet.

According to another aspect of the present disclosure, at least one fluid inlet includes a plurality of fluid inlets arranged along a peripheral edge of a pad base.

According to another aspect of the present disclosure, a plurality of inner bristles is disposed within at least one fluid flow channel.

According to another aspect of the present disclosure, a pad base includes a support plate and a scrubber pad coupled to the support plate. The scrubber pad defines at least one fluid flow channel. A plurality of inner bristles is coupled to the support plate and extends beyond an outer surface of the scrubber pad.

According to another aspect of the present disclosure, a scrubber pad is constructed of a closed cell foam material.

According to another aspect of the present disclosure, a peripheral seal is coupled to a guide and extends adjacent to a peripheral edge of a pad base.

According to another aspect of the present disclosure, a peripheral seal includes a plurality of outer bristles.

According to another aspect of the present disclosure, a peripheral seal includes an arced contact surface.

According to another aspect of the present disclosure, a peripheral seal includes ribs on an arced contact surface.

According to another aspect of the present disclosure, a peripheral seal extends beyond an outer surface of a pad base to form a seal with a surface to be cleaned.

According to another aspect of the present disclosure, a portable cleaning apparatus includes a base housing. A suction assembly is operably coupled with the base housing. A liquid delivery system is operably coupled with the base housing. A wand is coupled to the base housing via an accessory hose. A rotary scrubbing tool is selectively coupled to the wand. The rotary scrubbing tool includes a motor assembly, a connector for engaging the wand, and a pad base operably coupled to the motor assembly. The pad base defines an air outlet proximate to a rotational axis and a plurality of liquid outlets adjacent to the air outlet and in fluid communication with the liquid delivery system. A plurality of fluid flow channels extends from the air outlet to a peripheral edge of the pad base. The plurality of liquid outlets is defined in the plurality of fluid flow channels. The pad base also defines a plurality of fluid inlets adjacent to the peripheral edge. The suction assembly directs air into the rotary scrubbing tool, through the air outlet, across the pad base along the plurality of fluid flow channels, and through the plurality of fluid inlets. Liquid dispensed from the liquid delivery system via the plurality of liquid outlets is distributed across the pad base in the plurality of channels and through the plurality of fluid inlets via the air directed by the suction assembly.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure, as shown in the exemplary embodiments, are illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts, or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A cleaning apparatus, comprising:

a housing;

a suction assembly;

a liquid delivery system;

a wand in fluid communication with the suction assembly and the liquid delivery system via an accessory hose; and a rotary scrubbing tool selectively coupled to the wand, wherein the rotary scrubbing tool includes:

a motor assembly including a motor housing defining an air vent;

a support member including a connector and a guide coupled to the motor housing, wherein the connector is configured to couple to the wand; and a pad base operably coupled to the motor assembly within an interior of the guide for driving rotation of the pad base, the pad base defining an air outlet and a liquid outlet proximate to a central rotational axis and a fluid inlet proximate to a peripheral edge of the pad base, wherein the suction assembly directs air along an airflow path through the air vent, through the motor housing, and through the air outlet, and further wherein liquid dispensed from the liquid delivery system via the liquid outlet is directed along a liquid flow path through the wand and to the liquid outlet, the liquid and the air being directed along a combined fluid flow path across the pad base and through the fluid inlet by the suction assembly.

2. The cleaning apparatus of claim 1, wherein the wand includes an actuator and a valve, and wherein the actuator is configured to open the valve to provide fluid communication between the liquid delivery system and the rotary scrubbing tool.

3. The cleaning apparatus of claim 1, wherein the pad base includes a scrubber pad that defines a fluid flow channel across the pad base along the combined fluid flow path extends, and wherein the rotary scrubbing tool includes a plurality of inner bristles disposed along the fluid flow channel.

4. The cleaning apparatus of claim 1, wherein the rotary scrubbing tool further includes a peripheral seal coupled to the guide and extending proximate to the peripheral edge of the pad base.

5. The cleaning apparatus of claim 4, wherein the peripheral seal extends beyond an outer surface of the pad base to form a seal around the pad base with a surface to be cleaned.

6. The cleaning apparatus of claim 1, wherein the rotary scrubbing tool further includes a fluid ring coupled to the guide of the support member and configured to direct the liquid from the connector to the pad base.

7. The cleaning apparatus of claim 1, wherein the guide defines a central opening, and wherein the motor assembly extends through the central opening to operably engage with the pad base.

8. The cleaning apparatus of claim 1, wherein the rotary scrubbing tool defines a fluid flow channel across the pad base along which the combined fluid flow path extends, wherein the liquid outlet is defined in the fluid flow channel, and wherein the fluid inlet is disposed in the fluid flow channel and adjacent to the peripheral edge.

9. The cleaning apparatus of claim 8, wherein the pad base includes a support plate and a surface treating element coupled to the support plate, wherein the fluid flow channel extends from an outer surface of the surface treating element to the support plate.

10. The cleaning apparatus of claim 4, wherein the peripheral seal includes a plurality of outer bristles that extend beyond an outer surface of the pad base to form an outer seal when engaged with a surface to be cleaned.

11. The cleaning apparatus of claim 1, further comprising:

a connecting hub operably coupled to the motor assembly and the pad base for translating rotation from the motor assembly to the pad base.

12. The cleaning apparatus of claim 11, wherein the connecting hub defines an airflow channel along which the airflow path extends for the air to be directed out of an interior of the motor housing.

13. The cleaning apparatus of claim 1, wherein the rotary scrubbing tool defines a fluid flow channel across the pad base along which the combined fluid flow path extends.

14. The cleaning apparatus of claim 13, wherein the liquid outlet is defined in the fluid flow channel, and further wherein the fluid inlet is disposed in the fluid flow channel adjacent to the peripheral edge.

15. A cleaning apparatus, comprising:

a housing;

a suction assembly;

a liquid delivery system;

a wand in fluid communication with the suction assembly and the liquid delivery system via an accessory hose; and a rotary scrubbing tool selectively coupled to the wand and configured to engage both horizontal surfaces and non-horizontal surfaces for a cleaning process, wherein the rotary scrubbing tool includes:

a motor assembly;

a support member including a connector and a guide, wherein the connector is configured to couple to the wand; and a pad base operably coupled to the motor assembly within an interior of the guide for driving rotation of the pad base, wherein the pad base includes a support plate and a scrubber pad coupled to the support plate, wherein a fluid flow channel extends from an outer surface of the scrubber pad and toward the support plate, the pad base defining an air outlet and a liquid outlet proximate to a central rotational axis and a fluid inlet proximate to a peripheral edge of the pad base, wherein the suction assembly directs air through the air outlet, across the pad base through the fluid flow channel, and through the fluid inlet, and further wherein liquid dispensed from the liquid delivery system via the liquid outlet is directed across the pad base through the fluid flow channel and through the fluid inlet by the suction assembly.

16. A cleaning apparatus, comprising:

a housing;

a suction assembly;

a liquid delivery system;

a wand in fluid communication with the suction assembly and the liquid delivery system via an accessory hose; and a rotary scrubbing tool selectively coupled to the wand, wherein the rotary scrubbing tool includes:

a motor assembly;

a support member including a connector and a guide, wherein the connector is configured to couple to the wand; and a pad base operably coupled to the motor assembly within an interior of the guide for driving rotation of the pad base, wherein the pad base includes a support plate, a scrubber pad defining a fluid flow channel, and bristles disposed in the fluid flow channel and coupled to the support plate, the pad base defining an air outlet and a liquid outlet proximate to a central rotational axis and a fluid inlet proximate to a peripheral edge of the pad base, wherein the suction assembly directs air through the air outlet, across the pad base, and through the fluid inlet, and further wherein liquid dispensed from the liquid delivery system via the liquid outlet is directed across the pad base and through the fluid inlet by the suction assembly.

* * * * *